US006904937B2

(12) United States Patent
Fischer

(10) Patent No.: US 6,904,937 B2
(45) Date of Patent: Jun. 14, 2005

(54) SWITCHABLE FLUID CONTROL VALVE SYSTEM

(75) Inventor: Thomas H. Fischer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/712,235

(22) Filed: Nov. 13, 2003

(65) Prior Publication Data

US 2004/0112445 A1 Jun. 17, 2004

Related U.S. Application Data

(60) Provisional application No. 60/432,474, filed on Dec. 11, 2002.

(51) Int. Cl.[7] ..... F15B 13/043
(52) U.S. Cl. ..... 137/625.64
(58) Field of Search ..... 137/625.64

(56) References Cited

U.S. PATENT DOCUMENTS 4,321,941 A * 3/1982 Hunschede et al. .... 137/625.64
5,174,338 A * 12/1992 Yokota et al. ..... 137/625.64
5,261,455 A * 11/1993 Takahashi et al. ..... 137/625.64
5,343,994 A * 9/1994 Kyrtsos ..... 137/625.64
6,408,883 B2 * 6/2002 Motoki et al. ..... 137/625.64

* cited by examiner

*Primary Examiner*—Gerald A. Michalsky
(74) *Attorney, Agent, or Firm*—Patrick M. Griffin

(57) ABSTRACT

A switchable fluid control valve assembly having a regulating spool and a pilot spool disposed within a common bore. A regulating spring urges the regulating spool toward a rest position wherein an oil supply port is fully uncovered. Supply oil entering the assembly causes the regulating spool to assume a position wherein oil flow is throttled to a downstream pressure insufficient to activate an associated valve deactivation mechanism but sufficient to provide lubrication to the engine. When activation of the mechanism is desired, a solenoid moves the pilot spool wherein oil at full pressure is engaged against the regulating spool, de-throttling the flow of oil to the mechanism. When the solenoid is again deactivated, a dump port is opened into the oil flow path, immediately reducing the pressure on the regulating spool which then moves to eclipse the supply port and open a path from the mechanism to drain.

11 Claims, 6 Drawing Sheets

SWITCHABLE FLUID CONTROL VALVE SYSTEM

RELATIONSHIP TO OTHER APPLICATIONS AND PATENTS

The present application draws priority from a pending U.S. Provisional Application, Ser. No. 60/432,474, filed Dec. 11, 2002.

TECHNICAL FIELD

The present invention relates to spool-type valves; and more particularly, to such valves as are commonly employed for switching and controlling flow of activation and lubricating fluids to various components of internal combustion engines; and most particularly, to a switchable oil control spool valve system having a regulating spool for regulating oil pressure and activation flow, and a pilot spool for switching between a high pressure activation mode and a low pressure regulating mode, both spools being disposed in a common bore in a common housing.

BACKGROUND OF THE INVENTION

Spool-type valves for controllably diverting the flow of fluids are well known. In a typical spool valve, a hollow piston, or "spool," having a plurality of radial ports through the spool wall is slidably disposed within a cylindrical body that is also provided with a plurality of internal annular grooves and radial ports extending through the body wall. The spool is variably positionable within the body to cause selected ports in the spool to be aligned with grooves and ports in the body, thereby permitting flow of fluid from outside the body through first aligned ports into the interior of the spool and out through second aligned ports. A plurality of different flow paths typically is possible by positioning the spool at a plurality of different axial positions within the body. Typically, the spool is connected to a linear solenoid actuator, whereby the spool may be axially positioned by signals from a controller such as a computerized engine control module, although other actuations such as pneumatic and hydraulic are within the scope of the invention as described below.

A common usage for an oil-control spool valve is to variably actuate engine control subsystems such as camshaft phasers and variable valve activation (VVA) mechanisms, and multi-step or valve deactivation mechanisms. In a two step valve mechanism, for example, the mechanism selects the lift profile (low or high) of an intake valve camshaft using a hydraulically activated roller finger follower (RFF).

In a simple configuration of this example, a spool valve supplies high pressure oil, typically from an engine-driven oil pump, to activate the RFF, and shuts off the oil supply to deactivate and drain pressure from the RFF. However, it is desirable that in RFF-deactivation mode the oil supply not be completely shut off, as other components of the valve train, such as camshaft lobes and rocker arms, continue to require flow of oil for lubrication. In the prior art, continued lubrication may require separate valving and/or complicated porting.

What is needed is an oil control valve assembly that is switchable not simply between on and off modes but between a pressure high enough for RFF activation and a controlled pressure low enough for lubrication but insufficient for RFF activation.

What is needed further is means for instantaneously switching of the oil supply from high-pressure mode to low-pressure mode.

SUMMARY OF THE INVENTION

A switchable oil control valve system in accordance with the invention comprises a spool valve assembly having a regulating spool and a pilot spool disposed within a common bore in the valve housing. An apertured stop fixedly disposed in the bore between the spools separates the bore into a regulating chamber and a pilot chamber and defines a spring seat for both a regulating spring and a pilot spring. The regulating spring urges the regulating spool toward a rest position wherein an oil supply port in the housing is fully uncovered. In operation, supply oil entering the valve is available to a first pressure face of the regulating spool such that, with proper selection of regulating spring strength, the regulating spool assumes an intermediate position wherein supply oil flow is throttled to a pressure insufficient to activate an associated deactivatable RFF but is sufficient to provide lubrication to moving parts in the mechanical valve train. The regulating spool and spring in the housing thus comprise a self-regulating hydraulic governor for oil flow and pressure through the spool valve. The pilot spool is actuable through an end of the housing by a linear solenoid. When activation of the RFF is desired, the solenoid is energized, urging the pilot spool to a first position wherein oil at full engine pressure is admitted to the pilot chamber. The oil flows through the apertured stop into the regulating chamber, and brings high oil pressure against a second and opposing pressure face of the regulating spool. The regulating spool is displaced thereby, fully opening the supply port and sending high pressure oil to activate the RFF. When deactivation of the RFF is desired, the solenoid is de-energized. The pilot spring urges the pilot spool to a second position wherein a dump port is opened into the oil flow path, immediately reducing to zero the pressure on the face of the regulating spool adjacent the stop. Residual pressure on the opposite face of the regulating spool causes the spool to move against the regulating spring to a new position wherein the inlet port is eclipsed and a path from the RFF to drain is opened via the pilot spool. As the residual pressure is gradually reduced via a sensing port in the regulating spool, the regulating spool returns to the first position wherein the drain path is closed and the throttling/regulating function for lubrication is resumed, awaiting the next call for RFF activation.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
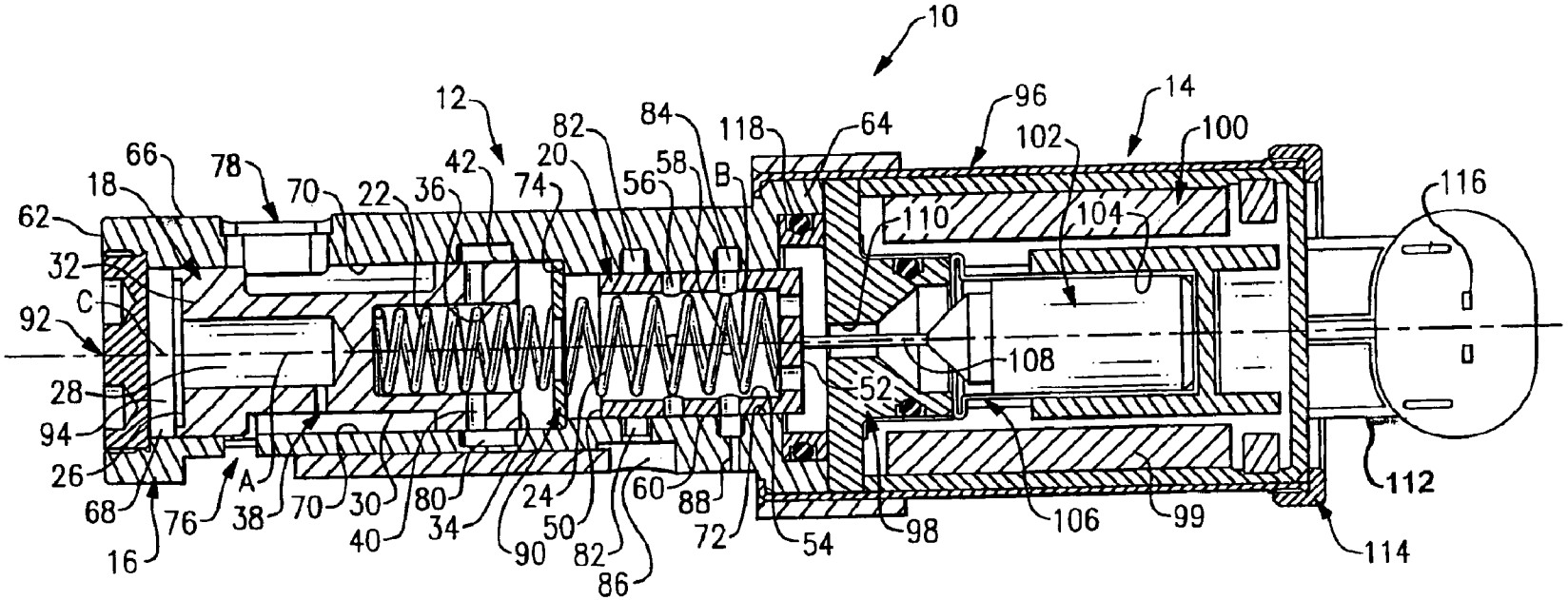
FIG. 1 is a cross-sectional view of a piloted control valve assembly in accordance with the invention, showing the principal components thereof.

Referring to FIG. 1, an integrated oil control valve assembly 10 in accordance with the present invention is shown. Valve assembly 10 includes spool valve assembly 12 and solenoid valve assembly 14. Spool valve assembly 12 includes generally cylindrical housing 16, regulating spool 18, pilot spool 20 and regulating and pilot springs 22,24, respectively. In operation, the axial position of regulating spool 18 within housing 16 regulates the pressure of oil flowing to an associated oil-actuated device such as a roller finger follower (not shown), and also to lubrication-requiring elements such as camshaft bearings and cam lobe surfaces. The axial position of pilot spool 20 determines the unregulated oil pressure in the system, either high pressure or zero pressure.

Regulating spool 18 defines first pressure end face 26, counter bore 28, flow annulus 30 disposed between a first end 32 and a second pressure end face 34 of regulating spool 18, and spring bore 36. Regulating spool 18 further defines central axis A wherein counter bore 18, flow annulus 30 and spring bore 36 are concentric with central axis A. Further included in regulating spool 18 are at least one radial sense port 38 fluidly connecting annulus 30 with counter bore 28 and at least one radial dump port 40 (3 are shown) fluidly connecting outside surface 42 of regulating spool 18 with spring bore 36.

Still referring to FIG. 1, cupped-shaped pilot spool 20 includes open end 50 and closed end 52. Pilot spool 20 defines spring pocket 54, at least one radial pressure port 56 and at least one dump/vent port 58. (In both cases, 3 are shown). Both the pressure ports and the dump/vent ports fluidly connect an outside surface 60 of pilot spool 20 with spring pocket 54. Pilot spool 20 further defines central axis B.

Generally cylindrical housing 16 of spool valve assembly 12 includes first end 62, second end 64, outer surface 66 and internal bore 68. Internal bore 68 defines a regulating chamber 70 having a first diameter, a pilot chamber 72 having a second diameter, and step 74 therebetween. The diameter of regulating chamber 70 is slightly larger than the diameter of pilot chamber 72 and both are concentric with central axis C of housing 16. Housing 16 also includes radial supply port 76 and radial control port 78, both fluidly connecting outside surface 66 of housing 16 with regulating chamber 70 of internal bore 68. Housing 16 further defines a first internal annular groove 80 disposed along the regulating chamber 70 of internal bore 68, a second internal annular groove 82 and a third annular groove 84 disposed along pilot chamber 72 of internal bore 68. Pilot port 86 intersects and is in fluid connection with second internal annular groove 82. Vent orifice 88 intersects with third internal annular groove 84 and fluidly connects groove 84 with outside surface 66 of housing 16.

Pilot spool 20 is slidably disposed in housing 16 so that its outside surface 60 is in close contact, i.e., substantially fluid tight, with the wall of pilot chamber 72 of housing 16. Regulating spool 18 is slidably disposed in housing 16 so that its outside surface 42 is in close contact, i.e., substantially fluid tight, with the wall of regulating chamber 70 of housing 16. Central axes A, B, and C are coincidentally aligned. Stop 90 having a central aperture 122 (FIG. 4) is fixedly positioned against step 74 to be held in place such as by, for example, press fit or welding.

Figure 2:
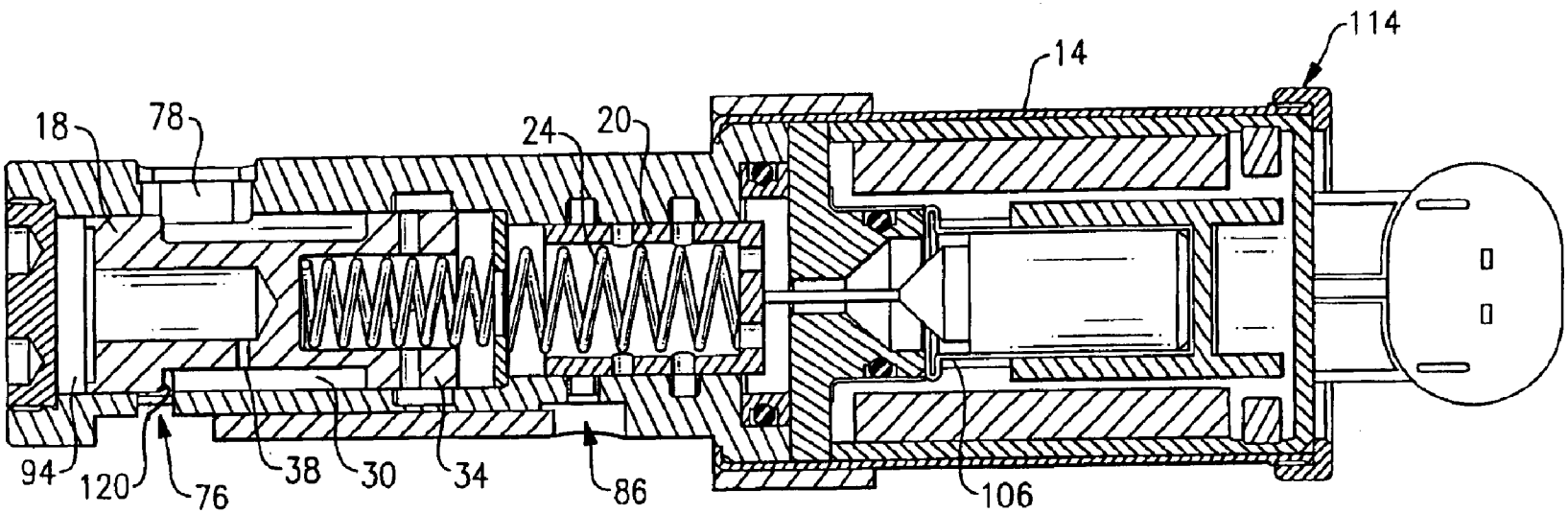
FIG. 2 is a cross-sectional view similar to the view shown in FIG. 1, showing the valve assembly in regulating mode.
Figure 3:
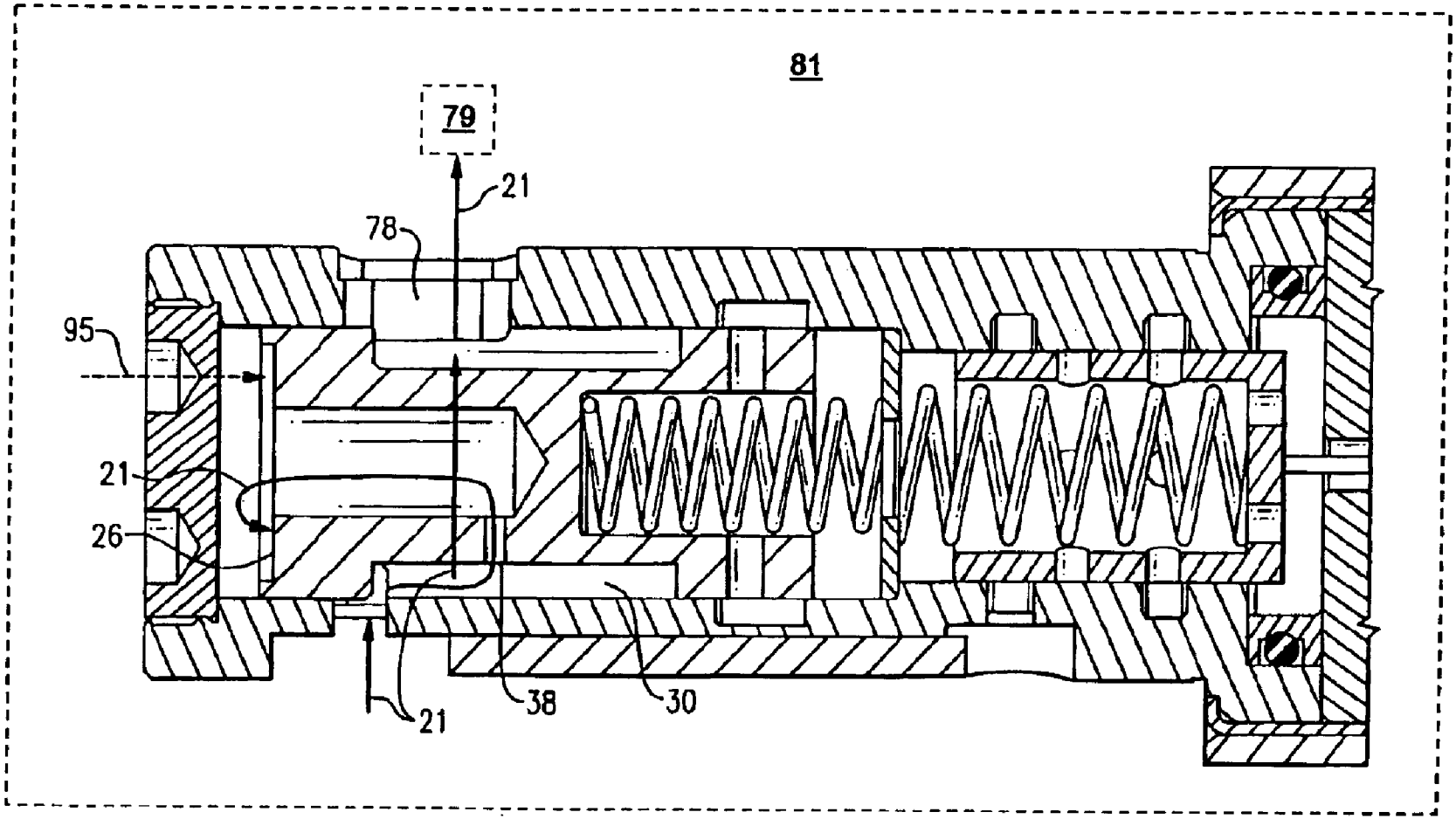
FIG. 3 is a cross-sectional view showing the path of oil flow through the valve assembly from the supply port to the control port during regulating (low pressure) mode, as shown in FIG. 2.

A first end of pilot spring 24 is in contact with stop 90 so as to bias pilot spool 20 to the right, as shown in FIGS. 1 and 2.

A first end of regulating spring 22 is in contact with stop 90 so as to bias regulating spool 18 to the left as shown in FIG. 2. First end 62 of housing 16 is closed off in a fluid tight manner by plug 92 as known in the art. When thus assembled, plug 92, internal bore 68 of housing 16, and first pressure end face 26 of regulating spool 18 conjunctively form an actuating chamber 94.

Still referring to FIG. 1, solenoid valve assembly 14 includes a frame 96 containing primary plate 98 and a plurality of windings 99 in bobbin assembly 100. A ferromagnetic plunger 102 is slidably disposed within an axial bore 104, plunger 102 defining a solenoid armature for cooperating electromagnetically with windings 99. An actuating shaft 108 is axially disposed and retained within plunger 102 and extends through axial bore 110 of primary plate 98 for connection with pilot spool 20. A generally cylindrical non-magnetic can 106 surrounds plunger 102 for slidably guiding and centering the plunger axially of primary plate 98. Electrical connector 112 is fixed to frame 96 by retainer ring 114, as is known in the art, and electrical leads (not shown) connect windings 99 to terminals 116, as also is known in the art. Solenoid assembly 14 is sealed against spool assembly 12 with O-ring seal 118, or the like, and rigidly fixed thereto by, for example, crimping the end of frame 96 over a mating end surface of second end 64 of housing 16.

Referring to FIGS. 2 through 6, the operation of integrated oil control assembly 10 will now be discussed. In the view shown in FIGS. 2 and 3, control assembly 10 is in its regulating mode. That is, solenoid valve assembly 14 is in its de-energized or "off" position, and pilot spring 24 is shown biasing pilot spool 20 to the right, (as shown in the figure). Thus, pilot spool 20 is not involved in regulating flow of oil to the RFF when the solenoid is de-energized.

Oil 21, fed under pressure as by the engine oil pump (not shown), is directed to supply port 76, flow annulus 30, through sense port 38, and into actuating chamber 94 where it presents hydraulic pressure 95 against first pressure face 26 of regulating spool 18. Oil also is directed around flow annulus 30 to control port 78, where the oil is directed through passages (not shown) to operate a 2-step roller finger follower of a corresponding 2-step valve activating mechanism 79 or other switchable control device (not shown) of internal combustion engine 81. In the pressure regulating mode, oil directed to the RFF is under relatively low pressure and, therefore, the RFF is positioned to operate in its "deactivated" mode. In this mode, oil can still flow to lubrication-requiring elements.

A self-regulated oil pressure is maintained by oil control valve assembly 10, as follows. As oil pressure at supply port 76 increases, pressure builds up against end face 26 causing regulating spool 18 to move to the right against regulating spring 22. As shown in FIG. 2, with movement of regulating spool 18 to the right, shoulder 120 of regulating spool 18 progressively eclipses supply port 76 and thereby progressively restricts the flow of oil through supply port 76, thereby reducing the amount and pressure of the oil flowing through flow annulus 30 and to the RFF through control port 78, until the hydraulic force produced by the control pressure balances the extensive force of regulating spring 22. Thus, the flow and pressure of oil to the RFF during deactivation thereof is self-governing. The resulting relatively low oil pressure is satisfactory for maintaining general lubrication of related mechanical surfaces not involved in activation and deactivation, for example, the cam surfaces and camshaft bearings.

Any small amount of oil leaking past regulating spool 18 toward pilot spool 20 is vented out of the assembly dump/ vent port 58, third internal annular groove 84 and vent orifice 88, as shown in FIG. 1. Since pilot port 86, which also receives oil under pressure from the engine oil pump, is closed-off by pilot spool 20 being positioned to the right, oil under pressure is not directed to second pressure end face 34 of regulating spool 18 to augment the extensive force of regulating spring 22. Thus, a relatively low oil pressure to the 2-step RFF is maintained, keeping the WA in deactivation mode.

Figure 4:
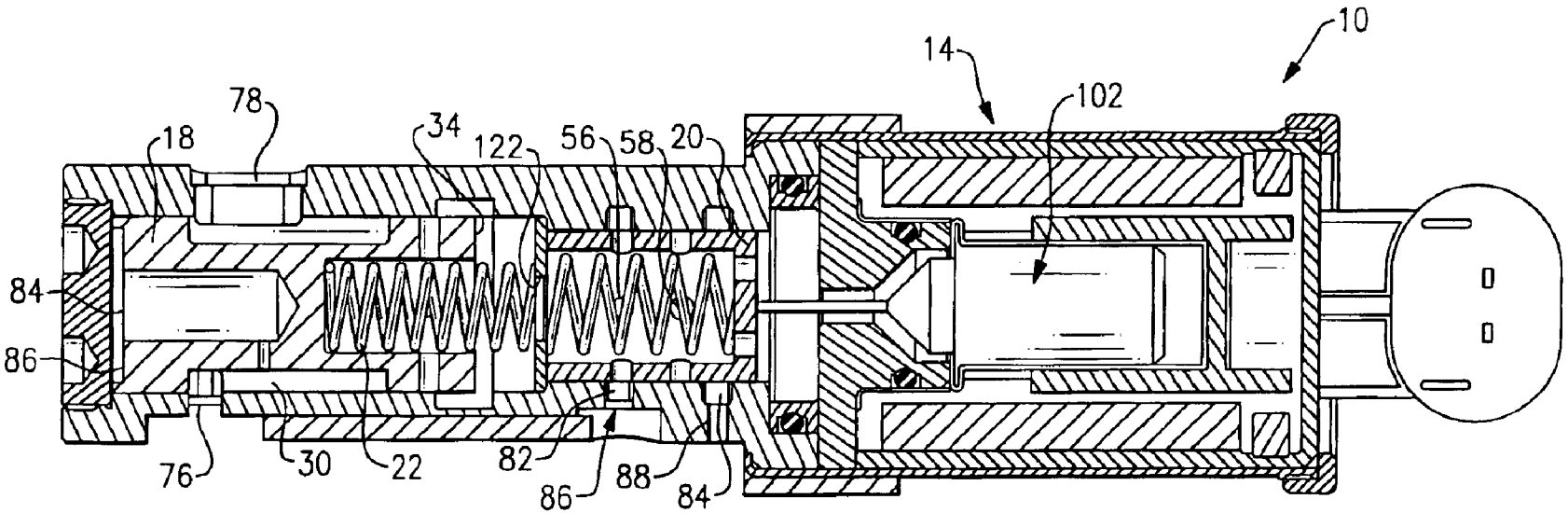
FIG. 4 is a cross-sectional view similar to the view shown in FIGS. 1 and 2, showing the valve assembly in high pressure mode.

The high pressure mode is shown in FIG. 4. In this mode, solenoid valve assembly 14 is in its energized or "on" position, and pilot spool 20 is moved to the left, as shown in the figure. Oil flow from dump/vent ports 58 is prevented from flowing into third internal annular groove 84 and out vent orifice 88. However, pressurized oil from the oil pump is permitted to flow into the assembly through pilot port 86, second internal annular groove 82 and pressure ports 56 where it communicates through stop aperture 122 and against second pressure face 34 of regulating spool 18. This pressure, coupled with the biasing force of regulating spring 22, overcomes the regulated hydraulic oil pressure 95 in chamber 94 and forces regulating spool 18 to move to the left as shown. This fully opens supply port 76 to flow annulus 30 and thereby imparts full, unregulated oil pressure to control port 78 and to the RFF to place the 2-step RFF in its activated or high-step mode. Of course, pressure in chamber 94 against first pressure face 26 will also increase to the full engine pump pressure, but it is offset by equal pressure against second pressure face 34 exerted by high pressure oil from supply port 86; thus, if faces 26,34 have equal areas, only the spring force is a factor in dictating the position of the regulating spool.

Figure 5:
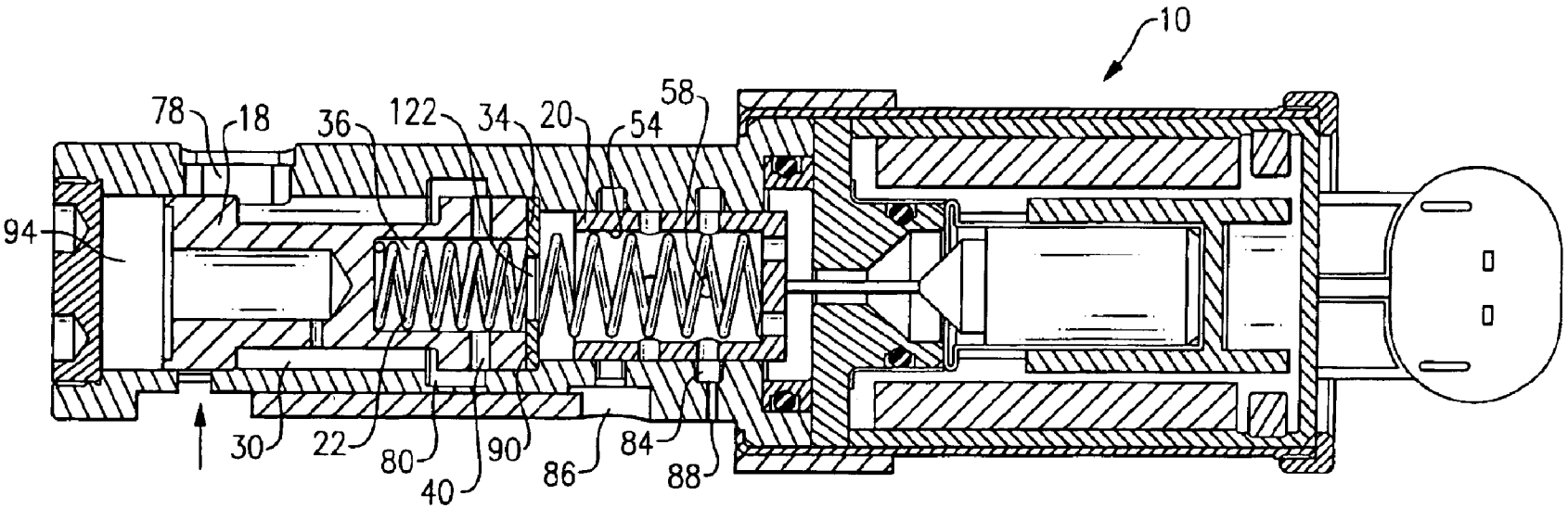
FIG. 5 is a cross-sectional view similar to the view shown in the previous drawings, showing the valve assembly in dump mode.
Figure 6:
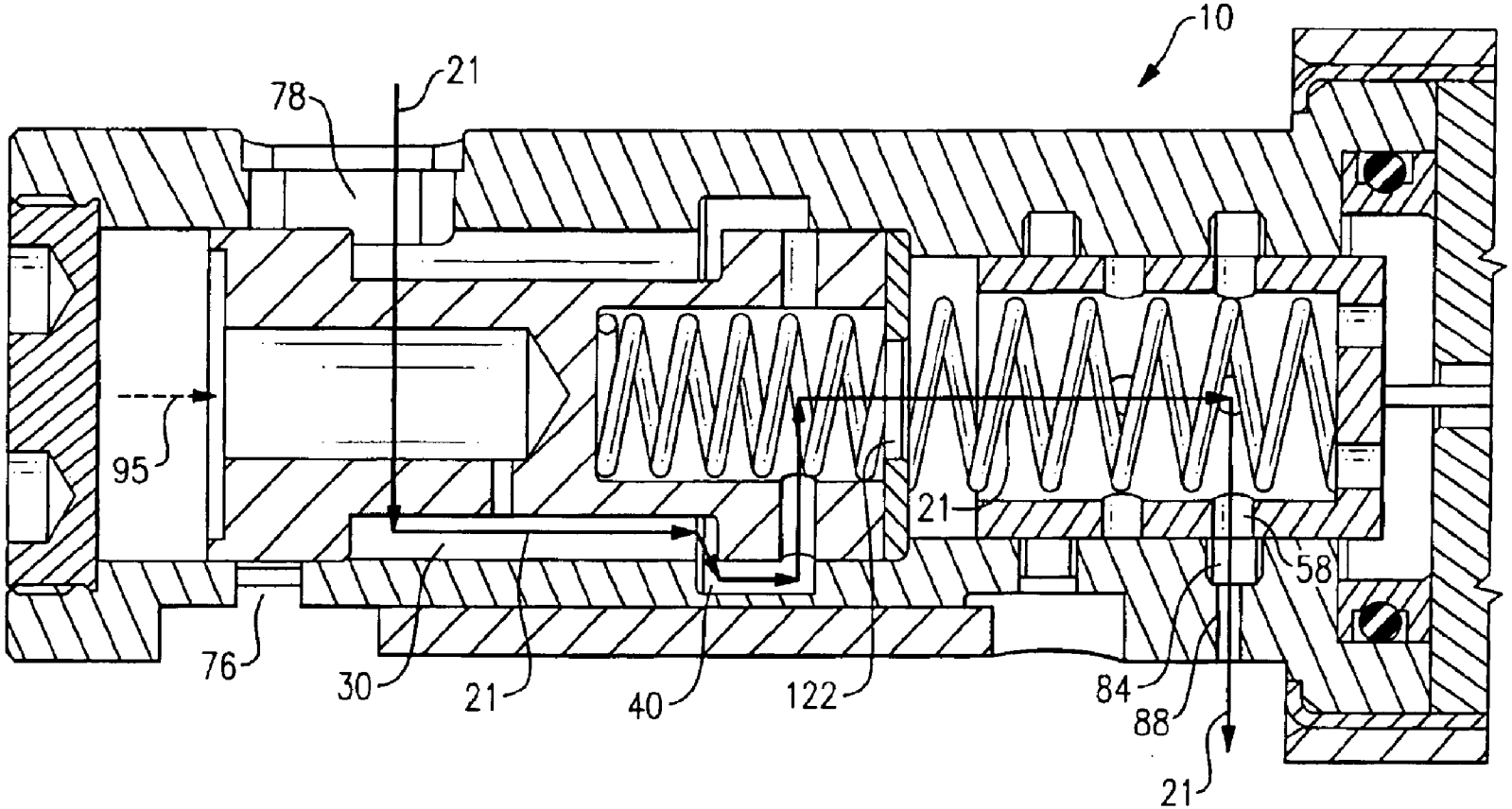
FIG. 6 is a cross-sectional view showing the path of oil flow through the valve assembly from the control port to the dump port during dump mode, as shown in FIG. 5.

FIGS. 5 and 6 show oil control assembly 10 in its dump mode. In this mode, the assembly rapidly returns the pressure of oil fed to the 2-step RFF from a high pressure for activating the RFF to a regulated pressure for deactivating the RFF. Solenoid valve assembly 14 is shown in its de-energized or "off" position again. Plunger 102 and pilot spool 20 are moved to the right, as shown in the figures. Oil flow from pilot port 86 is immediately blocked and flow of oil from dump/vent ports 58 into third internal annular groove 84 and out vent orifice 88 is again permitted, thereby instantaneously reducing the oil pressure against second end 34 of regulating spool 18. Since the oil pressure in actuating chamber 94 is still high, regulating spool 18 immediately moves full travel to the right against regulating spring 22 and against stop 90. In this position, oil flow through supply port 76 is blocked. Moreover, oil 21, under high pressure from the 2-step RFF flows back through control port 78, around flow annulus 30 where it is permitted to communicate through radial dump port 40 in regulating spool 18 via first internal annular groove 80 into spring bore 36, through stop aperture 122, into spring pocket 54, and out through dump/vent ports 58, third internal annular groove 84 and vent orifice 88. Thus, oil pressure is bled from the 2-step RFF to orifice 88 to immediately return the RFF from a high pressure, activated mode to a low-regulated pressure, deactivated mode. As pressure 95 in chamber 94 decays via oil flow out of actuation chamber 94 via sense port 38, regulating spring 22 urges regulating spool 18 to the left, causing the partial reopening of supply port 76, as assembly 10 is returned to the low pressure control mode shown in FIG. 2. Assembly 10 is now ready for reactivation to high pressure mode when needed.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A switchable fluid control valve assembly for controlling flow of a hydraulic fluid therethrough to an apparatus, comprising:

a) means for providing flow of said hydraulic fluid therethrough in a first operating mode at a first and high hydraulic pressure;

b) means for regulating flow of said hydraulic fluid therethrough in a second operating mode at a second and lower hydraulic pressure, wherein said second pressure is greater than zero; and c) means for switching alternatively between said first and second modes.

2. A valve assembly in accordance with claim 1 wherein said means for switching includes means for reducing said first pressure to a third pressure, wherein said third pressure is zero.

3. A switchable fluid control valve assembly for controlling flow therethrough at a first and higher hydraulic pressure and being switchable to regulate fluid flow therethrough at a second and lower downstream hydraulic pressure, the valve assembly comprising:

a) a housing having a longitudinal bore therein, said bore including a regulating chamber and a pilot chamber, said regulating chamber having at least a first fluid supply port for connection to a fluid source at said first pressure and a fluid control port for connection to an apparatus to be switchably controlled, and said pilot chamber having at least a second fluid supply port also for connection to said fluid source at said first pressure and a fluid dump port;

b) a regulating spool slidably disposed in said regulating chamber and having means for selectively eclipsing said first fluid supply port, said regulating spool having first and second opposed pressure faces;

c) a pilot spool slidably disposed in said pilot chamber and having means for selectively eclipsing said second fluid supply port and having means for selectively eclipsing said fluid dump port, said pilot spool further including means for selectively connecting said second fluid supply port with said regulating chamber;

d) regulating spring means for biasing said regulating spool toward a first extreme position in said regulating chamber;

e) pilot spring means for biasing said pilot spool toward a second extreme position in said pilot chamber;

f) actuation means attached to said pilot spool for selectively positioning said pilot spool within said pilot chamber to fluidly communicate alternatively either said second fluid supply port or said dump port with said second pressure face of said regulating spool; and g) an apertured separator fixedly disposed within said longitudinal bore to define a boundary between said regulating chamber and said pilot chamber, wherein said apertured separator defines a spring seat for each of said regulating spring means and said pilot spring means.

4. A valve assembly in accordance with claim 3 wherein said regulating spring means and said pilot spring means are coil compression springs, and wherein said apertured separator defines said spring seat for each of said springs.

5. A valve assembly in accordance with claim 3 wherein said actuation means is a linear solenoid.

6. A valve assembly in accordance with claim 5 wherein said solenoid may be energized to move said pilot spool to connect said second fluid supply port with said regulating chamber and may be de-energized to move said pilot spool to connect said dump port with said regulating chamber.

7. A valve assembly in accordance with claim 3 wherein said first pressure face is opposed to said regulating spring means, the assembly further comprising fluid communicating means connecting said first supply port with said first pressure face such that fluid flow through said fluid communicating means causes said regulating spool to be moved axially of said bore, thereby partially eclipsing said first supply port and reducing hydraulic pressure downstream of said first supply port and causing said fluid to be provided from said valve assembly to said apparatus at said second and lower hydraulic pressure.

8. A valve assembly in accordance with claim 7 wherein said fluid is engine oil.

9. An internal combustion engine comprising a two-step valve activation mechanism having a switchable fluid control valve assembly for controlling flow of engine oil therethrough to the two step valve activation mechanism, comprising:

a) means for providing flow of said oil therethrough in a first operating mode at a first and high hydraulic pressure to activate said two step valve activation mechanism;

b) means for regulating flow of said oil therethrough in a second operating mode at a second and lower hydraulic pressure to deactivate said two step activation mechanism; and c) means for switching alternatively between said first and second modes.

10. An engine in accordance with claim 9 wherein said means for switching includes means for rapidly reducing said first pressure to a third pressure, wherein said third pressure is zero.

11. A switchable fluid control valve assembly for controlling flow therethrough at a first and higher hydraulic pressure and being switchable to regulate fluid flow therethrough at a second and lower downstream hydraulic pressure, the valve assembly comprising:

a) a housing having a longitudinal bore therein, said bore including a regulating chamber and a pilot chamber, said regulating chamber having at least a first fluid supply port for connection to a fluid source at said first pressure and a fluid control port for connection to an apparatus to be switchably controlled, and said pilot chamber having at least a second fluid supply port also for connection to said fluid source at said first pressure and a fluid dump port;

b) a regulating spool slidably disposed in said regulating chamber and having means for selectively eclipsing said first fluid supply port, said regulating spool having first and second opposed pressure faces;

c) a pilot spool slidably disposed in said pilot chamber and having means for selectively eclipsing said second fluid supply port and having means for selectively eclipsing said fluid dump port, said pilot spool further including means for selectively connecting said second fluid supply port with said regulating chamber;

d) regulating spring means for biasing said regulating spool toward a first extreme position in said regulating chamber, wherein said regulating spring means is a regulating coil compression spring;

e) pilot spring means for biasing said pilot spool toward a second extreme position in said pilot chamber, wherein said pilot spring means is a pilot coil compression spring;

f) actuation means attached to said pilot spool for selectively positioning said pilot spool within said pilot chamber to fluidly communicate alternatively either said second fluid supply port or said dump port with said second pressure face of said regulating spool; and g) an apertured separator fixedly disposed within said longitudinal bore to define a boundary between said regulating chamber and said pilot chamber, wherein said apertured separator defines a spring seat for each of said regulating coil compression spring and said pilot coil compression spring.

* * * * *